US010451360B2

(12) United States Patent
Zager et al.

(10) Patent No.: US 10,451,360 B2
(45) Date of Patent: Oct. 22, 2019

(54) HEAT EXCHANGER WITH INTEGRAL ANTI-ICING

(71) Applicant: Hamilton Sundstrand Corporation, Windsor Locks, CT (US)

(72) Inventors: Michael Zager, Windsor, CT (US); Michael Doe, Southwick, MA (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 0 days.

(21) Appl. No.: 15/332,574

(22) Filed: Oct. 24, 2016

(65) Prior Publication Data

US 2018/0112934 A1 Apr. 26, 2018

(51) Int. Cl.

| | |
|---|---|
| ***F28F 3/04*** | (2006.01) |
| ***B21D 53/04*** | (2006.01) |
| ***F28F 21/08*** | (2006.01) |
| ***F28F 1/02*** | (2006.01) |
| ***F28F 1/12*** | (2006.01) |

(52) U.S. Cl.

CPC ..... *F28F 3/04* (2013.01); *B21D 53/04* (2013.01); *F28F 1/022* (2013.01); *F28F 1/126* (2013.01); *F28F 21/082* (2013.01); *F28F 21/086* (2013.01); *F28F 21/087* (2013.01); *F28F 2225/04* (2013.01); *F28F 2225/06* (2013.01)

(58) Field of Classification Search

CPC .. F28F 21/082; F28F 1/022; F28F 3/04; F28F 1/126; F28F 21/086; F28F 21/087; B21D 53/04

See application file for complete search history.

(56) References Cited

U.S. PATENT DOCUMENTS 6,725,912 B1 4/2004 Moll et al.
6,942,023 B2 * 9/2005 Fang ..... F28D 1/0443 165/140
9,182,175 B2 11/2015 Behrens et al.
(Continued)

FOREIGN PATENT DOCUMENTS

EP 0881448 A2 12/1998
EP 2208955 A1 7/2010
(Continued)

OTHER PUBLICATIONS

Extended European Search Report for EP Application No. 17197974.3, dated Mar. 28, 2018, 8 pages.
(Continued)

*Primary Examiner* — Jon T. Schermerhorn, Jr.
(74) *Attorney, Agent, or Firm* — Kinney & Lange, P.A.

(57) ABSTRACT

A heat exchanger includes a plurality of first and second fluid passages. The first fluid passages are defined by a pair of opposing first fluid passage walls and a plurality of first fluid diverters disposed between the first fluid passages walls. The second fluid passages are defined by a pair of opposing second fluid passage walls and a plurality of second fluid diverters disposed between the second fluid passage walls. The second fluid diverters include a body portion and a leading edge portion. The first fluid passage walls form a first fluid leading edge that extends upstream of the leading edge portion of the second fluid diverters. The second fluid passages extend in a direction perpendicular to the direction of the first fluid passages.

15 Claims, 3 Drawing Sheets

(56) References Cited

U.S. PATENT DOCUMENTS

| | | | | |
|---|---|---|---|---|
| 2007/0044939 | A1* | 3/2007 | Hummel | F02B 29/0456 165/41 |
| 2010/0089546 | A1 | 4/2010 | Perez et al. | |
| 2015/0361922 | A1* | 12/2015 | Alvarez | F28D 9/0081 165/185 |

FOREIGN PATENT DOCUMENTS

| | | |
|---|---|---|
| GB | 582142 | 11/1946 |
| JP | 2005241168 A | 9/2005 |

OTHER PUBLICATIONS

Communication pursuant to Article 94(3) EPC for European Application No. 17197974.3, dated May 28, 2019, 4 pages.

* cited by examiner

HEAT EXCHANGER WITH INTEGRAL ANTI-ICING

BACKGROUND

An aircraft heat exchanger is sometimes exposed to icing conditions at its cold inlet face. Cold air flow from the turbine of an air cycle machine or sub-freezing ambient air may contain snow or ice particles that can damage the leading edges of the cold inlet fins. Flow blockages are caused when the leading edges are bent, or when the snow and ice particles accumulate on the cold inlet face at a rate that exceeds its melting capability. Snow or ice particles can also pierce hot fluid passages and cause leaks that reduce system efficiency.

One method of providing ice protection is to make the cold air flow bypass the heat exchanger when snow or ice accumulates on the cold inlet face until the face has warmed sufficiently to melt the accumulation. This, however, requires additional parts at the cold inlet face which can be difficult to fit into the available space on an aircraft. Accordingly, there is a need for a cold inlet face design with integral ice-melting features.

SUMMARY

A heat exchanger includes a plurality of first and second fluid passages. The first fluid passages are defined by a pair of opposing first fluid passage walls and a plurality of first fluid diverters disposed between the first fluid passages walls. The second fluid passages are defined by a pair of opposing second fluid passage walls and a plurality of second fluid diverters disposed between the second fluid passage walls. The second fluid diverters include a body portion and a leading edge portion. The first fluid passage walls form a first fluid leading edge that extends upstream of the leading edge portions of the second fluid diverters. The second fluid passages extend in a direction generally perpendicular to the direction of the first fluid passages.

A method of making a heat exchanger comprises: forming a plurality of opposing first fluid passage walls and a plurality of first fluid diverters disposed between the first fluid passages walls, wherein the plurality of first fluid passage walls and first fluid diverters define a plurality of first fluid passages; forming a plurality of opposing second fluid passage walls and a plurality of second fluid diverters disposed between the second fluid passage walls, wherein the plurality of second fluid passage walls and second fluid diverters define a plurality of second fluid passages. The second fluid diverters include a body portion and a leading edge portion. The first fluid passage walls form a first fluid leading edge that extends upstream of the leading edge portions of the second fluid diverters. The second fluid passages extend in a direction generally perpendicular to the direction of the first fluid passages.

DETAILED DESCRIPTION

The disclosed heat exchanger includes integral ice-melt passages. Additive manufacturing is used to produce a cold inlet face with the ice-melt passages extending upstream of the fins in the cold flow stream. Additional enhancements can also be achieved at the cold inlet face using additive manufacturing. For example, certain surfaces can be thickened, such as the leading edges of the cold fins and the ice melt-passages. Fins can also be added to the inner surfaces of the ice-melt passages. These integral ice-melt features allow for the optimization of the melting capability of the cold inlet face and reduce the amount of materials traditionally required to achieve the design.

Figure 1:
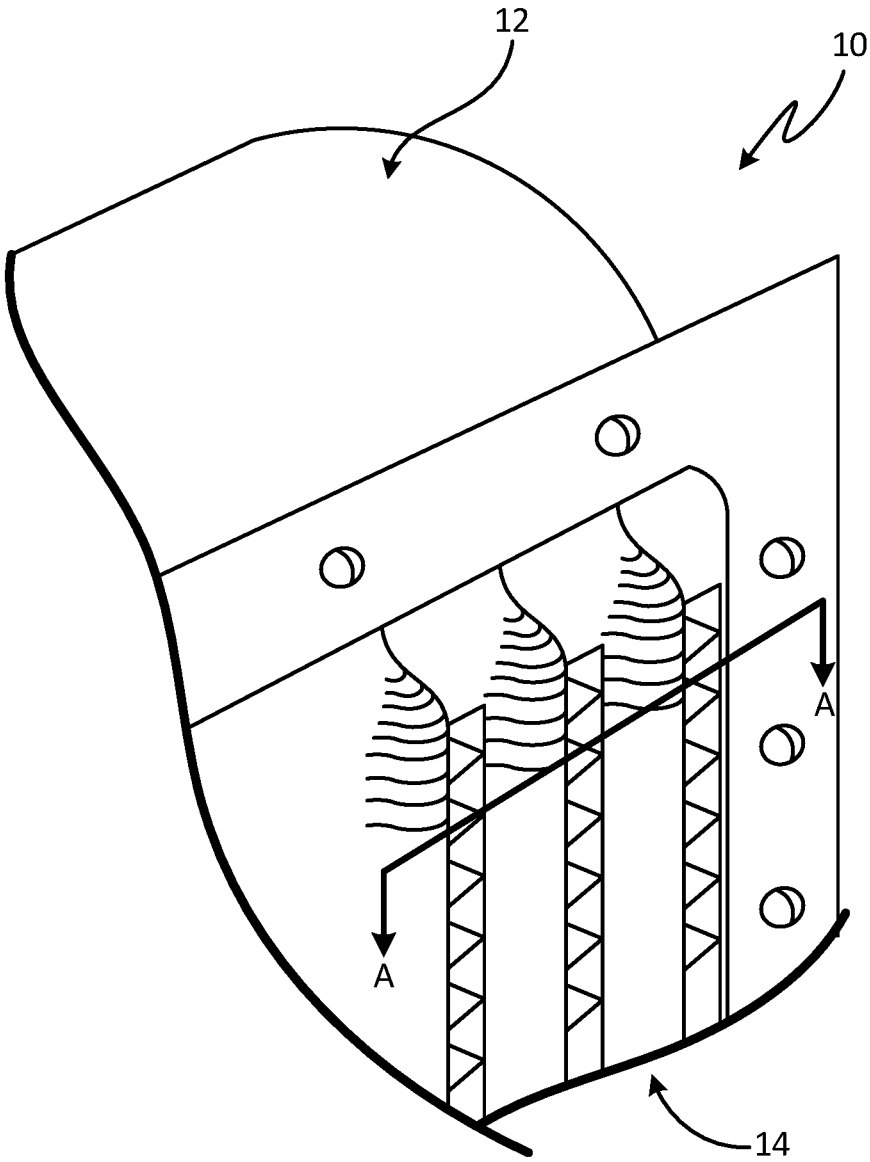
FIG. 1 is a perspective view of the cold inlet face of a heat exchanger.

FIG. 1 is a perspective view of heat exchanger 10 of an aircraft. Heat exchanger 10 includes header 12, cold inlet face 14, a plurality of first fluid passages (not labeled in FIG. 1), and a plurality of second fluid passages (not labeled in FIG. 1). Heat exchanger 10 is configured to receive a cold fluid at cold inlet face 14. The cold fluid can be, for example, air cycle machine turbine exhaust or sub-freezing ram air. Heat exchanger 10 is also configured to receive a hot fluid via header 12. The hot fluid can be supplied from within the environmental control system. Often times, the hot fluid is engine bleed air after it has been cooled by other heat exchangers.

Figure 2:
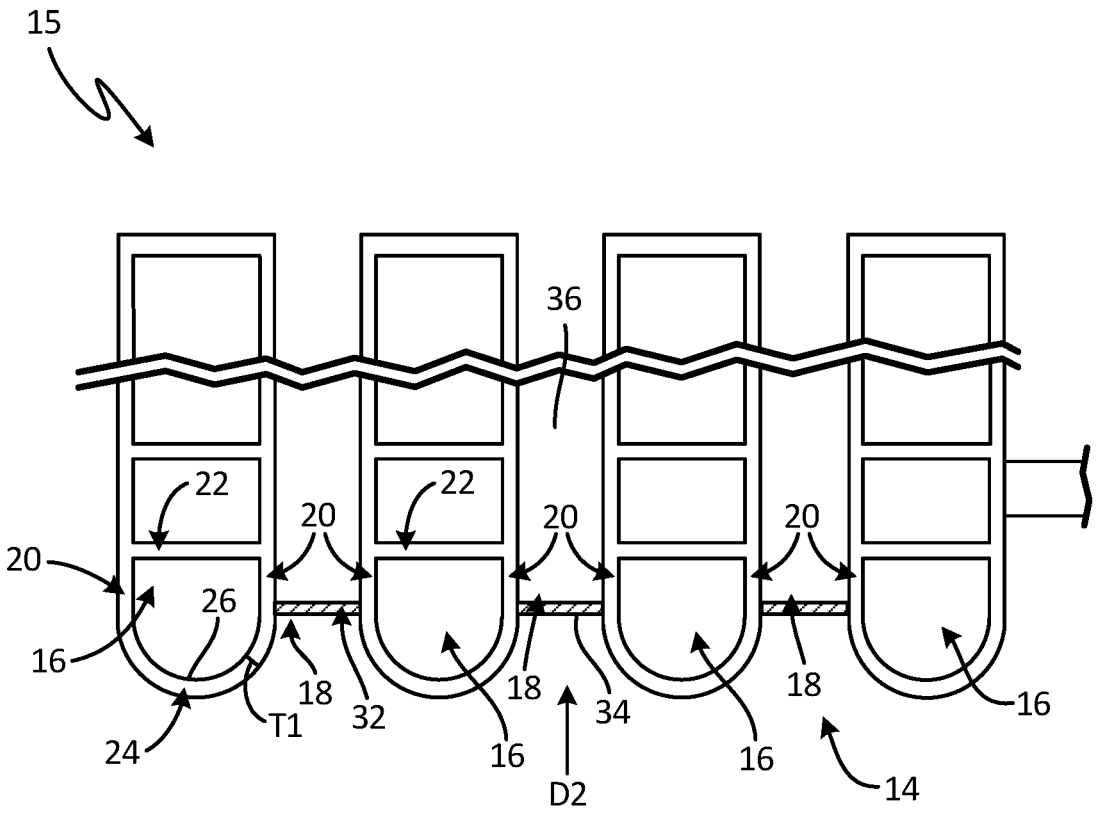
FIG. 2 is a cross-sectional view of the heat exchanger of FIG. 1.
Figure 3:
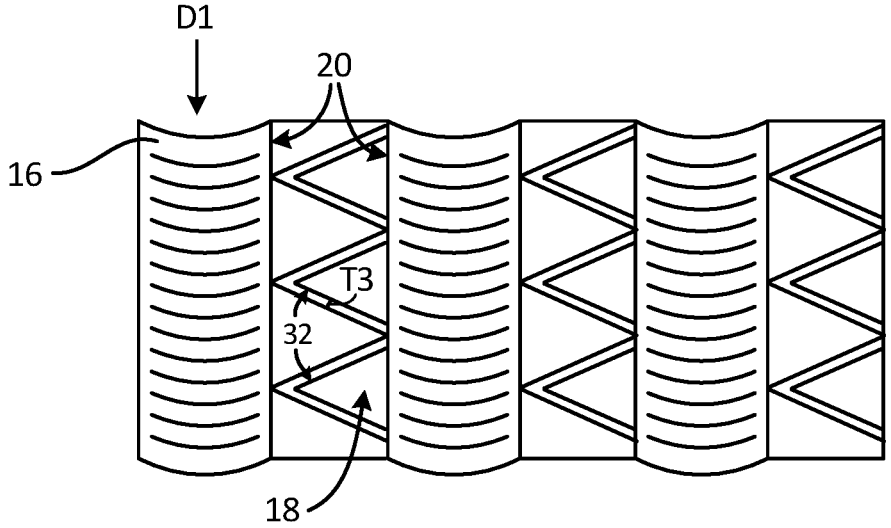
FIG. 3 is a front view of the cold inlet face of the heat exchanger of FIG. 1.

Referring to FIGS. 2 and 3, first fluid passages 16 are defined by opposing first fluid passages walls 20, and first fluid diverters 22. First fluid diverters 22 are disposed between first fluid passage walls 20. Walls 20 meet to form leading edge 24. Leading edge 24 has an inner surface 26. Walls 20 and leading edge 24 have a uniform thickness T1. First fluid passages 16 receive the hot fluid from header 12. In one embodiment, first fluid passage walls 20 and first fluid diverters 22 are formed from aluminum. In other embodiments, other suitable materials can be used.

Second fluid passages 18 are defined by opposing second fluid passage walls 20 and second fluid diverters 32. Second fluid diverters 32 are disposed between second fluid passage walls 20. In the embodiment shown, second fluid diverters 32 are configured as fins, but can also be configured as pins, or a combination of fins and pins. Second fluid diverters 32 have a leading edge portion 34, and a body portion 36. Leading edge portion 34 has a thickness T3 that can be greater than a thickness T4 (not shown) of the body portion. In some embodiments, thickness T3 can be anywhere from 110% to 500% of thickness T4. In one embodiment, second fluid passage walls 20 and second fluid diverters 32 are formed from aluminum. In other embodiments, other suitable materials can be used.

First fluid passages 16 extend in a direction D1. Second fluid passages extend in a direction D2 toward outlet end 15. As can be seen from FIGS. 2 and 3, direction D2 is perpendicular to direction D1.

The cold fluid flowing into the heat exchanger at cold inlet face 14 does not always flow in a single direction, rather the fluid flow can be multi-directional and swirling in nature. The swirling fluid can contain snow and ice particles. The increased thickness T3 of leading edge portions 34, present in some embodiments, protects the second fluid diverters 32 from damage caused by snow and ice particles. Leading edges 24 of first fluid passages 16 extend upstream of leading edge portions 34 of second fluid diverters 32, which also protects leading edge portions 34 from snow and ice particles. This occurs because leading edge portions 34 are recessed rearward from the incoming cold fluid flow. Further, leading edges 24 of first fluid passages 16 can melt snow and ice particles before they reach second fluid passages 18 because they provide additional hot surface area with which the cold fluid can come into contact and be warmed as it enters cold inlet face 14. In some embodiments, leading edges 24 of first fluid passages 16 can extend up to approximately twice the width of second fluid passages (cold passages) 18 beyond leading edge portions 34 of second fluid diverters 32 into the upstream flow.

Figure 4:
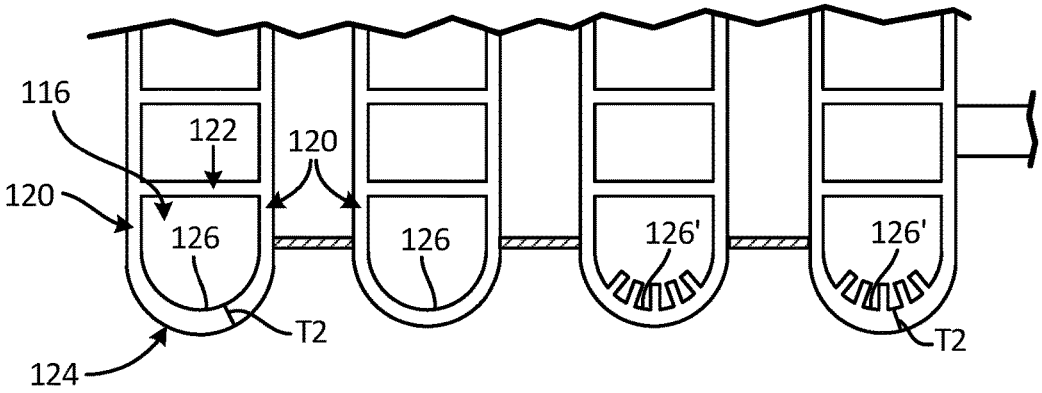
FIG. 4 is a cross-sectional view of an alternative embodiment of the heat exchanger of FIG. 1.

Referring to FIG. 4, a heat exchanger with additional ice-melt enhancements is shown. First fluid passages 116 are defined by a pair of opposing first fluid passage walls 120, and first fluid diverters 122. First fluid diverters 122 are disposed between first fluid passage walls 120. Walls 120 meet to form leading edge 124. Leading edge 124 has an inner surface 126. Leading edge 124 can also have a thickness T2. In one embodiment, thickness T2 is greater than thickness T1 of the embodiment of FIG. 2. That is, leading edge 124 has walls that are thicker than the sidewalls of walls 120 as shown in FIG. 4.

In another embodiment also shown in FIG. 4, leading edge 124 includes finned inner surface 126' to increase the heat transfer surface area of the first fluid passages 116. In yet another embodiment, leading edge 124 has an increased thickness T2 and finned inner surface 126'.

In the disclosed embodiments, the opposing walls, diverters, and leading edges of the first and second fluid passages can be formed from aluminum. However, in other embodiments, other suitable materials, such as steel, nickel alloys, titanium, non-metal materials, or combinations of such materials, can be used. Further, first fluid passages 16, 116 of the disclosed embodiments have a parabolic shape, however, the first fluid passages can be formed into other shapes based on the specific need for ice protection at cold inlet face 14.

Heat exchanger 10 can be manufactured by an additive manufacturing process such as, direct metal laser sintering (DMLS), laser net shape manufacturing (LNSM), electron beam manufacturing (EBM), or laminated object manufacturing (LOM), to name a few non-limiting examples. Additive manufacturing techniques can include, for example, forming a three-dimensional object through layer-by-layer construction of a plurality of thin sheets of material, or through powder bed fusion. Heat exchanger 10 can be designed to have optimal melting capabilities based on parameters such as flow volume and temperature.

Heat exchanger 10 can be additively manufactured by forming a plurality of first and second fluid passage walls and diverters, which define a plurality of first and second fluid passages. The first fluid passage walls form a first fluid leading edge. The second fluid diverters include a body portion, and a leading edge portion that can be made to have a thickness 110% to 500% of that of the body portion during the manufacturing process. The first fluid leading edges are formed to extend upstream of the leading edge portions of the second fluid diverters.

Additional ice-melt enhancements can be included during the manufacturing process. For example, the first fluid passage walls and the first fluid leading edges can be made thicker. Further, the inner surface of the first fluid leading edges can be finned to increase the heat transfer surface area within the first fluid passages.

It will be appreciated that heat exchanger 10 is formed by additive manufacturing using techniques that will allow it to conform to the available space on an aircraft or other structure without influencing the placement of other components.

Discussion of Possible Embodiments

The following are non-exclusive descriptions of possible embodiments of the present invention.

A heat exchanger includes a plurality of first and second fluid passages. The first fluid passages are defined by a pair of opposing first fluid passage walls and a plurality of first fluid diverters disposed between the first fluid passages walls. The second fluid passages are defined by a pair of opposing second fluid passage walls and a plurality of second fluid diverters disposed between the second fluid passage walls. The second fluid diverters include a body portion and a leading edge portion. The first fluid passage walls form a first fluid leading edge that extends upstream of the leading edge portions of the second fluid diverters. The second fluid passages extend in a direction generally perpendicular to the direction of the first fluid passages.

The heat exchanger of the preceding paragraph can optionally include, additionally and/or alternatively, any one or more of the following features, configurations and/or additional components:

The second fluid diverters are selected from the group consisting of fins, pins, and combinations thereof.

The body portion of the second fluid diverter has a first thickness, and the leading edge portion of the second fluid diverter has a second thickness.

The second thickness ranges from about 110% to about 500% of the first thickness.

The first fluid passage walls have a first wall thickness, and the first fluid passage leading edge has a second thickness greater than the first wall thickness.

The first fluid passage leading edge has an inner surface, and wherein the inner surface comprises fins.

The plurality of first and second fluid passage walls and diverters are formed from aluminum.

The plurality of first and second fluid passage walls and diverters are formed from a material selected from the group consisting of steel, nickel alloys, titanium, non-metal materials, and combinations thereof.

A method of making a heat exchanger comprises: forming a plurality of opposing first fluid passage walls and a plurality of first fluid diverters disposed between the first fluid passages walls, wherein the plurality of first fluid passage walls and diverters define a plurality of first fluid passages; forming a plurality of opposing second fluid passage walls and a plurality of second fluid diverters disposed between the second fluid passage walls, wherein the plurality of second fluid passage walls and diverters define a plurality of second fluid passages. The second fluid diverters include a body portion and a leading edge portion. The first fluid passage walls form a first fluid leading edge that extends upstream of the leading edge portions of the second fluid diverters. The second fluid passages extend in a direction generally perpendicular to the direction of the first fluid passages.

The method of the preceding paragraph can optionally include, additionally and/or alternatively, any one or more of the following features, configurations and/or additional components:

The method includes increasing a thickness of the leading edge portion of the second fluid diverter by about 110% to about 500% relative to a thickness of the body portion of the second fluid diverter.

The method includes forming the first fluid passage leading edge such that it has a thickness greater than a thickness of the first fluid passage walls downstream of the first fluid passage leading edge.

The method includes forming fins on an inner surface of the first fluid passage leading edge.

The method includes forming the heat exchanger by additive manufacturing.

The method includes forming the heat exchanger from aluminum.

The method includes forming the heat exchanger from a material selected from the group consisting of steel, nickel alloys, titanium, non-metal materials, and combinations thereof.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A heat exchanger comprising:

a plurality of first fluid passages, the plurality of first fluid passages defined by:

a pair of opposing first fluid passage walls each having a first wall thickness; and a plurality of first fluid diverters disposed between the first fluid passage walls;

wherein each of the plurality of first fluid passages extends in a first direction and is configured to receive a first fluid flow in the first direction; and a plurality of second fluid passages, the plurality of second fluid passages defined by:

a pair of opposing second fluid passage walls; and a plurality of second fluid diverters disposed between the second fluid passage walls;

wherein each of the plurality of second fluid diverters comprises a body portion and a leading edge portion; and wherein each of the plurality of second fluid passages extends in a second direction perpendicular to the first direction and is configured to receive a second fluid flow in the second direction;

wherein one of the plurality of first fluid passages is an upstream first fluid passage defined by the first fluid passage walls which meet to form a first fluid leading edge located upstream, relative to the second fluid flow, of the leading edge portions of the second fluid diverters, wherein another of the plurality of first fluid passages abuts the upstream first fluid passage on a side opposite the first fluid leading edge, wherein the first fluid leading edge has a leading edge thickness greater than the first wall thickness, and wherein the first fluid leading edge is situated upstream of the leading edge portions of the second fluid diverters a distance equivalent to at least twice a width of an individual one of the plurality of second fluid passages.

2. The heat exchanger of claim 1, wherein the second fluid diverters are selected from the group consisting of fins, pins, and combinations thereof.

3. The heat exchanger of claim 1, wherein the body portion of the second fluid diverter has a first thickness, and the leading edge portion of the second fluid diverter has a second thickness.

4. The heat exchanger of claim 3, wherein the second thickness is between 110% to 500% of the first thickness.

5. The heat exchanger of claim 1, wherein the first fluid passage leading edge has an inner surface, and wherein the inner surface comprises fins.

6. The heat exchanger of claim 1, wherein the plurality of first fluid passage walls and diverters, and the plurality of second fluid passage walls and diverters are formed from aluminum.

7. The heat exchanger of claim 1, wherein the plurality of first fluid passage walls and diverters, and the plurality of second fluid passage walls and diverters are formed from a material selected from the group consisting of steel, nickel alloys, titanium, and combinations thereof.

8. The heat exchanger of claim 1, wherein the plurality of first fluid passage walls and diverters, and the plurality of second fluid passage walls and diverters are formed from a non-metal material.

9. A method of making a heat exchanger comprising:

forming a plurality of opposing first fluid passage walls each having a first wall thickness, and a plurality of first fluid diverters disposed between the first fluid passage walls;

wherein the plurality of first fluid passage walls and the plurality of first fluid diverters define a plurality of first fluid passages extending in a first direction and configured to receive a first fluid flow in the first direction; and forming a plurality of opposing second fluid passage walls, and a plurality of second fluid diverters disposed between the second fluid passage walls;

wherein the plurality of second fluid passage walls and the plurality of second fluid diverters define a plurality of second fluid passages extending in a second direction perpendicular to the first direction and configured to receive a second fluid flow in the second direction; and wherein each of the plurality of second fluid diverters comprises a body portion and a leading edge portion;

wherein one of the plurality of first fluid passages is an upstream first fluid passage defined by the first fluid passage walls which meet to form a first fluid leading edge located upstream, relative to the second fluid flow, of the leading edge portions of the second fluid diverters, wherein another of the plurality of first fluid passages abuts the upstream first fluid passage on a side opposite the first fluid leading edge, wherein the first fluid leading edge has a leading edge thickness greater than the first wall thickness, and wherein the first fluid leading edge is situated upstream of the leading edge portions of the second fluid diverters a distance equivalent to twice a width of an individual one of the plurality of second fluid passages.

10. The method of claim 9, further comprising: forming the leading edge portion of the second fluid diverter such that is has a thickness between 110% to 500% relative to a thickness of the body portion of the second fluid diverter.

11. The method of claim 9, further comprising: forming fins on an inner surface of the first fluid passage leading edge.

12. The method of claim 9, further comprising: forming the heat exchanger by additive manufacturing.

13. The method of claim 9, further comprising: forming the heat exchanger from aluminum.

14. The method of claim 9, further comprising: forming the heat exchanger from a material selected from the group consisting of steel, nickel alloys, titanium, and combinations thereof.

15. The method of claim 9 and further comprising: forming the heat exchanger from a non-metal material.

* * * * *